US007044095B2

(12) United States Patent
Subramanya

(10) Patent No.: US 7,044,095 B2
(45) Date of Patent: May 16, 2006

(54) ROLLER TAPPET WITH COLD ADVANCE

(75) Inventor: Kaidala Nanjunda Rao Subramanya, Bangalore (IN)

(73) Assignee: Robert Bosch GmbH, Stuttgart (DE)

( * ) Notice: Subject to any disclaimer, the term of this patent is extended or adjusted under 35 U.S.C. 154(b) by 110 days.

(21) Appl. No.: 10/489,598

(22) PCT Filed: Nov. 14, 2002

(86) PCT No.: PCT/EP02/12746

§ 371 (c)(1),
(2), (4) Date: Mar. 15, 2004

(87) PCT Pub. No.: WO2004/007948

PCT Pub. Date: Jan. 22, 2004

(65) Prior Publication Data

US 2004/0237915 A1 Dec. 2, 2004

(30) Foreign Application Priority Data

Jul. 15, 2002 (IN) ..... 600/MAS/01

(51) Int. Cl.
*F01L 1/14* (2006.01)

(52) U.S. Cl. ..... 123/90.48; 123/90.49; 123/90.55; 123/501

(58) Field of Classification Search ..... 123/90.48, 123/90.49, 90.55, 90.56, 500, 501, 502, 90.12, 123/90.13; 92/129, 133, 134; 239/569, 239/570, 571, 583, 584
See application file for complete search history.

(56) References Cited

U.S. PATENT DOCUMENTS 5,193,510 A * 3/1993 Straubel ..... 123/502
6,406,269 B1 * 6/2002 Dingle et al. ..... 417/218

FOREIGN PATENT DOCUMENTS

EP 1 076 173 A2 2/2001
WO WO 01/14728 A1 3/2001

* cited by examiner

*Primary Examiner*—Thomas Denion
*Assistant Examiner*—Ching Chang
(74) *Attorney, Agent, or Firm*—Ronald E. Greigg

(57) ABSTRACT

A cold advance device for advancing the injection beginning in cold condition diesel engine with single plunger pumps, by means of which the injection onset is adjusted in cold conditions and also in normal conditions. A piston is provided in the roller tappet and the roller tappet moves up and down in response to lubricating oil pressure through a plate valve. The lubricating oil lifts the hydro tappet piston enabling the pump plunger to be in the advance position. The pump plunger is lifted an amount corresponds to 8° to 10° crank angle depending upon the cam profile. The stroke of the piston is limited by a stopper and is designed according to the cold advance requirements of the engine. The plate valve is provided with a throttle hole.

6 Claims, 2 Drawing Sheets

ROLLER TAPPET WITH COLD ADVANCE

CROSS-REFERENCE TO RELATED APPLICATIONS

This application is a 35 USC 371 application of PCT/EP 02/12746 filed on Nov. 14, 2002.

BACKGROUND OF THE INVENTION

1. Field of the Invention

This invention is directed to an improved roller tappet device with a cold advance for advancing the injection beginning in cold condition starting a diesel engine.

2. Description of the Prior Art

Various devices are in existence for injection related to single and multi cylinder diesel engine with single plunger pumps. The main drawback in the existing devices include:

a. difficulty in achieving easy start,
b. difficulty in achieving quick warm-up,
c. difficulty in achieving start in cold condition,
d. difficulty in achieving the emission requirements with reference to cold start and white smoke.

The known prior devices are not satisfactory and are not convenient. As mentioned hereinafter, in accordance with this invention, the performance can be highly enhanced if there is a device which provides a quick warm-up and easy starting from a cold condition and the device performs normally in a warm condition. Thus according to this invention there is provided an improvement which exhibits considerably improved performance over the devices of the prior art by allowing the pump plunger to be in an advance position in cold conditions.

OBJECT AND SUMMARY OF THE INVENTION

This invention provides a cold advance device for advancing the injection beginning in cold condition (−25° C. to +40° C.) in single and multi-cylinder diesel engine with single plunger pumps, for easy startability and quick warm up and to achieve the emission requirements with reference to cold start and white smoke.

When the roller tappet is in bottom dead centre position, lubricating oil which is at pressure of 2.5 to 3.0 bar, flows through the plate valve and lifts the hydro tappet piston by, for example, 1.5 mm. With this, the pump plunger is 1.5 mm in advance position as compared to normal operating position. This 1.5 mm lift corresponds to 8° to 10° crank angle depending upon the cam profile. A stopper limits the stroke of the piston. The stroke of the device is designed according to the cold advance requirement of the engine. The plate valve connected to lubricating oil supply pump provides a hydraulic lock and prevents the lubricating oil leakage due to injection pressure. When the engine is in cold conditions (−25° C. to +40° C.), the plunger is in the advance position. In the warm condition (>40° C.) the lubricating oil is cut off. Due to the lubricating oil leakage through the throttle hole on the plate valve, the pump plunger collapses back to the normal operating position.

In cold condition, the lubricating oil inlet pressure prevents the lubricating oil leakage through the throttle hole. The size of the throttle hole is selected depending upon the pump plunger diameter and the peak injection pressure of the pump.

The invention provides startability and quick warm up of the engine and enables achieving the emission requirements which reference to cold start and white smoke.

The invention is related to the cold advance device consisting of a piston which moves up and down with a roller tappet against pump plunger spring force and lifts the pump plunger due to the lubricating oil pressure, a plate valve which provides hydraulic lock and a throttle hole on the plate valve which facilitates the collapse of the pump plunger to the normal position as soon as the lubricating oil supply is cut off.

Detailed Description of the Invention

Thus according to the invention, a cold advance device for use in single and multi cylinder diesel engine with single plunger pumps, comprises of:

A piston 12 is provided in the roller tappet 10, such that it moves the roller tappet 10 up and down, due to flow of lubricating oil supplied from a lubricating oil supply pump (30) via passage 28, which oil is at a pressure of 2.5–3 bar, through a plate valve 14. The lubricating oil which flows through the plate valve 14, lifts the hydro tappet piston 12 by, for example, 1.5 mm. The 1.5 mm lift enables the pump plunger 22 to be mm in the advance position. The said 1.5 mm lift of the said plunger 22 corresponds to 8° to 10° crank angle depending upon the profile of cam 26.

The stroke of the piston 12 is limited by a stopper 18. The stroke of the cold advance device is designed according to the cold advance requirement of the engine. The plate valve 14 provides a hydraulic lock and therein prevents lubricating oil leakage due to injection pressure. The plate valve 14 is provided with a throttle hole 15. A return means is provided wherein the throttle hole 15 facilities the collapse of the said pump plunger 22 to the normal position as soon as the lubricating oil supply is cut-off by cut-off means such as the temperature responsive valve 32, due to the leakage of the lubricating oil through the throttle hole 15 in the plate valve 14.

The size of the throttle hole 15 on the plate valve 14 is selected relative to the diameter of the pump plunger 22 and the peak injection pressure of the pump.

In the embodiment described, the cold advance according to the invention achieves easy startability and also achieves quick warm up.

Without departing from the scope and spirit of the invention, the cold advance device according to the invention is easily adaptable for extended range of temperature other than specified herein in this specification.

Cold Condition

When the roller tappet 10 is in the bottom dead centre position, lubricating oil which is at a pressure, for example, of 2.5 to 3.0 bar, flows through the throttle 15 in plate valve 14 and lifts the hydro tappet piston 12 by into engagement with the stopper 12, for example, 1.5 mm. The lubricating oil inlet pressure prevents the lubricating oil leakage through the throttle hole 15 in the plate valve 14. With the lift of the piston 12 by 1.5 mm, the pump plunger 22 is 1.5 mm in advance position relative to normal operating position. The said 1.5 mm lift may correspond to 8° to 10° crank angle depending upon the cam profile. The stroke of the piston 12 is limited by providing a stopper 18. The stroke of the device is based on the cold advance requirement of the engine. Thus in a cold condition (−25° C. to +40° C.), the lubricating oil which is under pressure lifts the piston 12 and pushes the pump plunger 22 in the advance position and the hydraulic lock of the plate valve 14, as herein described above, holds the pump plunger 22 in the advance position.

Warm Condition

When the engine is warm, the lubricating oil supply is cut off by the temperature responsive valve 32. The throttle hole 15 in the plate valve 14 allows the leakage of the lubricating oil, and facilitates the collapse of pump plunger 22 back to its normal operating position.

BRIEF DESCRIPTION OF THE DRAWINGS

An embodiment of the invention will now be described by way of illustration and example, and without limiting the scope of the invention, with reference to the accompanying drawings in which.

DESCRIPTION OF THE PREFERRED EMBODIMENT

Figure 1:
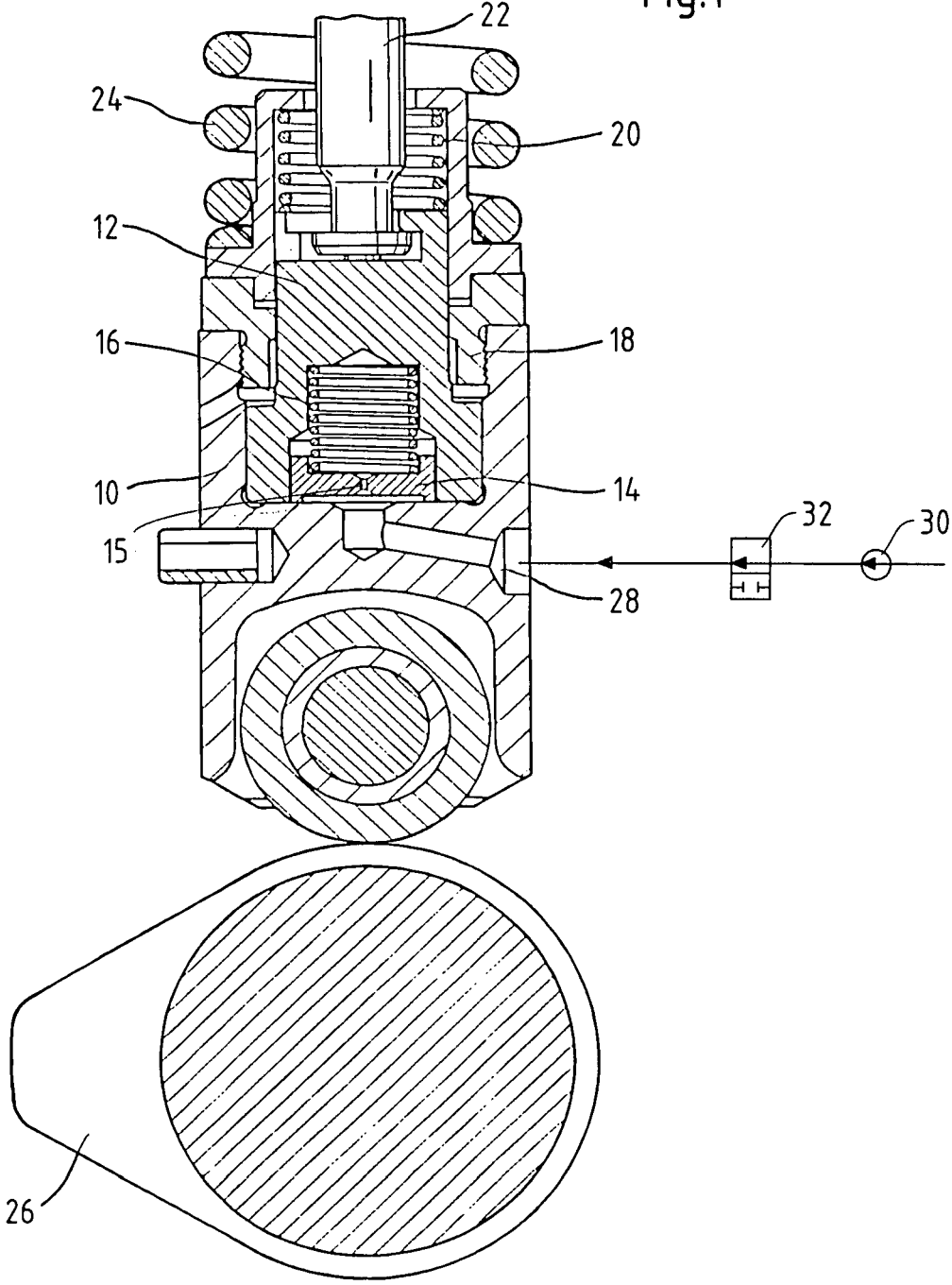
FIG. 1 shows the cross sectional view of the roller tappet 10 with cold advance.

Referring to FIG. 1, the device consists of the roller tappet 10 with cold advance piston 12, the plate valve 14, throttle hole 15 in plate valve 14, valve spring 16, stopper 18 and plunger spring 20. The pump plunger 22 and tappet spring 24 are also shown. The fuel injection cam 26 is shown in BDC position. The cold advance piston 12 is in the collapsed (warm) condition. Engine oil supplied by a pum 30 is controlled by a suitable temperature responsive valve 32.

Figures 2A, 2B, 2C:
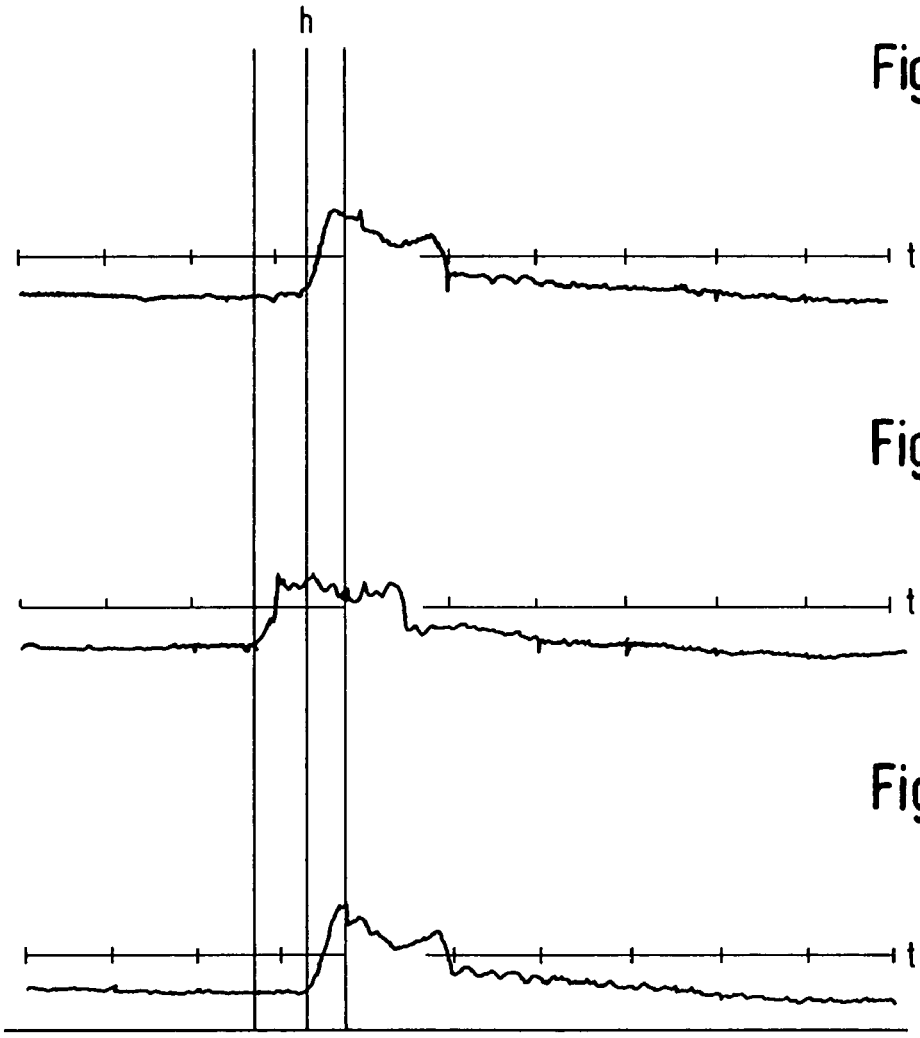
FIG. 2*a,* 2*b* and 2*c* show the nozzle needle lift h of injection valve from test results of the cold advance roller tappet sample at cam speed 1400 rpm over time t.

FIG. 2*a* shows the nozzle needle lift and fuel injection curve at the nozzle end in the initial position.

FIG. 2*b* shows the nozzle needle lift and fuel injection curve advanced by 10° crank, when 2.5 bar lubricating oil is supplied to the roller tappet 10.

FIG. 2*c* shows the nozzle needle lift and fuel injection curve back in the initial position when the lubricating oil supply is cut off. This applies to the warm condition.

The collapsing time at this speed is 3 seconds.

The foregoing relates to preferred exemplary embodiment of the invention, it being understood that other variants and embodiments thereof are possible within the spirit and scope of the invention, the latter being defined by the appended claims.

The invention claimed is:

1. A roller tappet device suitable for warm start and adaptable for variation of pump plunger position in advance for cold start for use on single/multiple cylinder diesel engine with single plunger pump, the roller tappet device comprising:

lubricating oil supply means (30) to supply oil at a desired pressure to the roller tappet (10), a movable piston (12) in the roller tappet (10) in position to engage and adjust the pump plunger (22) position in advance and thereby achieve desired crank angle, a plate valve (14) connected to the lubricating oil supply means such that the lubricating oil flowing through the plate valve (14) provides a force thrust on the piston (12), which lifts the piston (12) upward to thereby advance the pump plunger (22) position, a stopper means (18) provided for the piston (12) to limit the stroke of the piston (12), a cut off means (32) connected to lubricating supply means such that the lubricating oil supply is connected to or cut off from the roller tappet (10) depending upon temperature conditions, and a return means wherein throttle hole (15) is provided in said plate valve (14) such that throttle hole (15) facilitates the collapse of said pump plunger (22) position upon activation of oil supply cut off by the cut off means.

2. A roller tappet device suitable for warm start and adaptable for variation of pump plunger position in advance for cold start for use on single/multiple cylinder diesel engine with single plunger pump, as claimed in claim 1, wherein the said lubricating oil from the said lubricating oil supply means (30) flows through said plate valve (14) is at a pressure of 2.5–3 bar.

3. A roller tappet device suitable for warm start and adaptable for variation of pump plunger Position in advance for cold start for use on single/multiple cylinder diesel engine with single plunger pump, as claimed in claim 1, wherein the said lubricating oil flows through the said plate valve (14), lifts the piston (12) by 1.5 mm and enables the pump plunger to be 1.5 mm in the advance position.

4. A roller tappet device suitable for warm start and adaptable for variation of pump plunger position in advance for cold start for use on single/multiple cylinder diesel engine with single plunger pump, as claimed in claim 1, wherein device is adapted to advance the injection in cold condition of temperature about −25° C. to +40° C.

5. A roller tappet device suitable for warm start and adaptable for variation of pump plunger position in advance for cold start for use on single/multiple cylinder diesel engine with single plunger pump, as claimed in claim 1, wherein the size of the said throttle hole (15 on the said plate valve (14), is relative to the selected diameter of the said pump plunger and the peak injection pressure of the pump.

6. A roller tappet device suitable for warm start and adaptable for variation of pump plunger position in advance for cold start for use on single/multiple cylinder diesel engine with single plunger pump, as claimed in claim 1, wherein the said piston (12) moves up and down in the roller tappet (10) against pump plunger spring (20) force and lifts the pump plunger (22) due to the lubricating oil pressure.

* * * * *